United States Patent [19]

Gustavsson et al.

[11] Patent Number: 4,785,859

[45] Date of Patent: Nov. 22, 1988

[54] VARIABLE VOLUME VESSEL HAVING A RIGID COVER AND A FLEXIBLE PART RECEIVABLE INTO THE COVER

[76] Inventors: Bengt Gustavsson, Bergsbogatan 29, S-421 79 Västra Frölunda; Ingvar Andersson, PL.80, S-450 34 Fiskebäckskil; Lars-Erik Linder, Valebergsvägen 319, S-427 00 Billdal, all of Sweden

[21] Appl. No.: 65,098

[22] Filed: Jun. 22, 1987

Related U.S. Application Data

[63] Continuation of Ser. No. 786,963, filed as PCT SE85/00056 on Feb. 6, 1985, published as WO85/03433 on Aug. 15, 1985, abandoned.

[30] Foreign Application Priority Data

Feb. 6, 1984 [SE] Sweden ..... 8307141

[51] Int. Cl.[4] ..... B65B 3/04

[52] U.S. Cl. ..... 141/313; 141/21; 604/408; 206/219

[58] Field of Search ..... 604/403, 408, 411, 413, 604/414, 415, 416; 220/85 B, 403, 404; 206/366, 219; 215/247; 141/329, 330, 313, 314, 10, 18, 25, 21, 26

[56] References Cited

U.S. PATENT DOCUMENTS

| | | | |
|---|---|---|---|
| 2,619,088 | 11/1952 | Saffir | 604/415 X |
| 2,855,933 | 10/1958 | Erikson | 604/415 |
| 3,064,652 | 11/1962 | Corcoran et al. | 604/408 |
| 3,209,752 | 10/1965 | Bujan et al. | 604/408 |
| 3,486,539 | 12/1969 | Jacuzzi | 141/329 |
| 4,032,064 | 6/1977 | Giggard | 220/85 B |
| 4,128,098 | 12/1978 | Bloom et al. | 141/27 X |
| 4,183,031 | 1/1980 | Kyser et al. | 141/329 X |
| 4,203,443 | 5/1980 | Genese | 604/413 |
| 4,236,647 | 1/1979 | Kotturan | 215/247 |
| 4,303,071 | 12/1981 | Smith | 604/403 |
| 4,307,766 | 12/1981 | Tanokura | 604/408 |
| 4,392,850 | 7/1983 | Elias et al. | 604/82 |
| 4,437,472 | 3/1984 | Noftulin | 604/408 X |

FOREIGN PATENT DOCUMENTS

| | | | |
|---|---|---|---|
| 539945 | 2/1957 | Italy | 604/415 |
| 840075 | 12/1984 | PCT Int'l Appl. . | |

*Primary Examiner*—Henry J. Recla
*Assistant Examiner*—Ernest G. Cusick
*Attorney, Agent, or Firm*—Ostrolenk, Faber, Gerb & Soffen

[57] ABSTRACT

A vessel for receiving fluid includes a flexible part having a closed end and an opening at its opposite end, and a rigid protective cover, the edges of the opening in the flexible part being attached to the rigid cover in a manner such that the inside of the flexible part and the inside of the cover define a closed interior space, the flexible part being capable of being drawn up against the inside of the protective cover upon evacuation of the interior space whereby the flexible part is received within the protective cover. A connection member is provided on the outside of the protective cover, the connection member having a bore therethrough and a perforatable, resilient, self-sealing membrane extending across the bore, through which membrane a puncturing member may be inserted for removing material from or adding material to the interior space. A protection member is supported by the protective cover within the interior space at the location of the connection member for preventing a puncturing member inserted through the connection member from contacting the flexible part, the protection member having at least one opening therein in communication with the interior space.

16 Claims, 3 Drawing Sheets

VARIABLE VOLUME VESSEL HAVING A RIGID COVER AND A FLEXIBLE PART RECEIVABLE INTO THE COVER

This is a continuation of application Ser. No. 786,963, filed as PCT SE85/00056 on Feb. 6, 1985, published as WO85/03433 on Aug. 15, 1985, which was abandoned upon the filing hereof.

TECHNICAL FIELD

The present invention refers to a volume variable vessel, for example for storing and/or collecting of fluid or dry substances and accessible through perforatable, resilient, self-sealing membrane arranged in or above an opening of a the vessel, said vessel consisting of flexible, diffusion-tight material, for example a plastic bag, the portion about the opening of the vessel being attached to a connection member in connection with a neck thereof in such a way that the interior of the vessel communicates with said neck, at which said membrane is arranged.

BACKGROUND OF THE INVENTION

When transferring liquid substances from a vessel, for example a vial, but also when adding a liquid to dry substances for dissolving the latter one can not avoid that the injection needle by which the liquid substance is taken from the vial can give off drops to the environment or come into contact with the persons handling the injection needle. Especially in cases where the substance, consists of cytostatica, allergy-inducing substances it is for safety reasons important that the transfer of such liquids from the vial to a patient, possibly by way of an infusion solution, takes place under satisfactory conditions and also so that an air contamination of the injection needle during the transfer is avoided. Today vials or ampoules are made of glass and the use thereof is associated with drawbacks; for example, the risk of cuts when breaking the ampoule is great.

SUMMARY OF THE INVENTION

The purpose of the invention is to provide a storing and/or collecting vessel, which is cheap and simple to handle and to manufacture, for example of a plastic material and which at the same time must be so designed that the needle of the injection syringe can not perforate the walls of the vessel. This object has been solved by the fact that said neck is provided with a rigid protective member extending into the vessel and which is arranged to prevent a puncturing member inserted into the vessel through the membrane from contacting the walls of the vessel and which is provided with at least one side opening admitting fluid communication.

DESCRIPTION OF THE PREFERRED EMBODIMENTS

Figure 2:
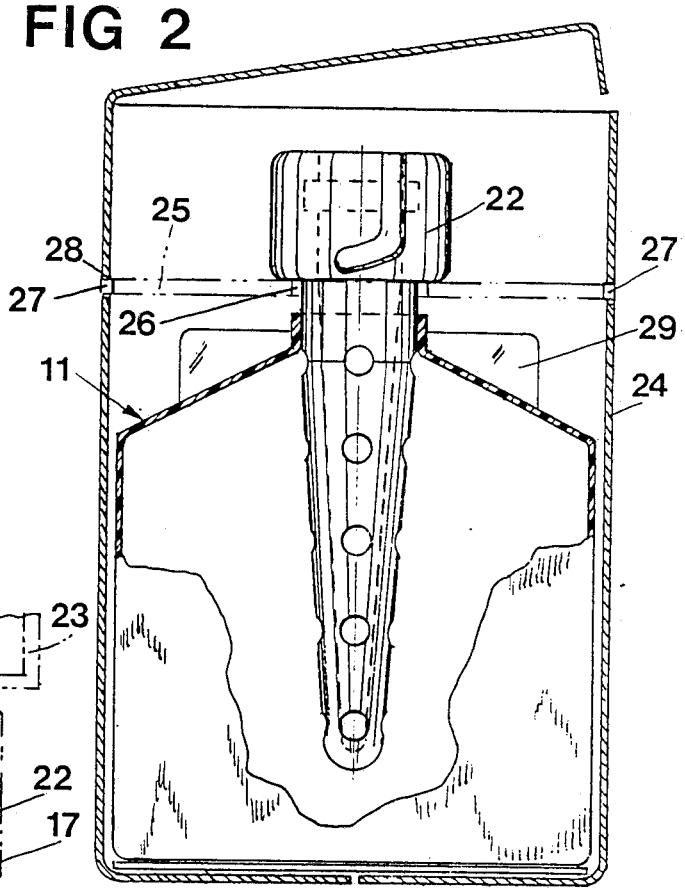
FIG. 2 shows a section through a modified vessel according to FIG. 1 placed in a transport cover.

The vessel according to the invention, on the drawings denoted with the numeral 11, has a bag-like shape and is manufactured from a flexible, diffusion-tight plastic material. The opening 12 of the bag is fixedly connected to a neck 13 of a conection member 14 likewise of a plastic material, and to which neck 13 the bag-shaped vessel 11 can be welded or liquid tightly connected in another way.

The connection member 14 is provided in the area about the mouth of the neck 13 with an inner peripheral groove 15 in which a membrane 16 is attached, which covers the opening 17 of the neck. At the side of the neck 13 facing away from the membrane 16 the neck is provided with an extended, sleeve-shaped protective member 18, the purpose of which is to prevent a needle 19 of an injection syringe inserted through the membrane 16 from coming into contact with the walls 20 of the bag 11. The sleeve-shaped protective member 18 is provided with radial perforations 21 admitting a fluid communication between the bag and the interior volume of the protective member.

Figure 1:
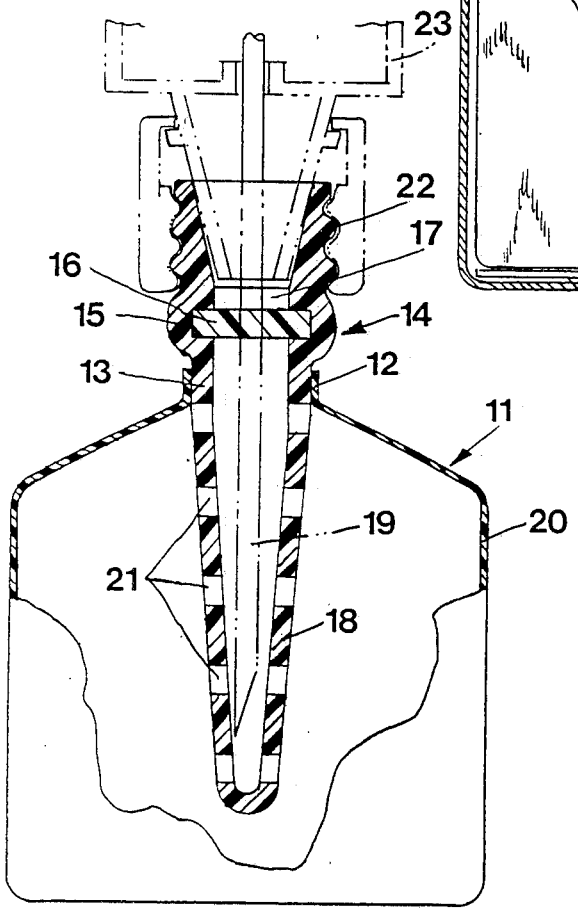
FIG. 1 shows a vessel according to an embodiment of the invention in a side view and partly in section.

The side of the connection member 14 facing away from the protective member 18 is provided with a coupling 22 which in the embodiment shown in FIG. 1 consists of a Luer-coupling, to which a contamination protection 23, for example according to the International Patent Application No. PCT/SE84/0075, can be connected by a simple manipulation.

The embodiment according to the FIG. 2 differs from the one according to the FIG. 1 by the fact that the coupling 22 consists of a so called bayonet coupling, which in the same way as in FIG. 1 can be brought to co-operate with a contamination protection provided with a corresponding male bayonet coupling member.

In order that the bag 11 during transport should not be damaged a transport cover 24 is preferably attached thereto, which cover can consist of a plastic or cardboard material, for example a capsular piece of cardboard. In the transport cover 24 the bag is fixed by means of a transport support 25 which can be a loose plate with a central hole 26, through which the neck of the connection member 14 is passed, as is shown in FIG. 2, and which plate is inserted by means of tongues 27 into corresponding recesses 28 in the transport cover 24. Instead of a loose plate, the transport support 25 can also consist of an integrated portion of the connection member 14. The transport cover 24 can preferably be provided with one or several windows 29 through which the bag 11 and its content can be observed. During transport the open end of the coupling can be provided with a lid or another seal so that the membrane is sterile when the seal is broken.

Figure 3:
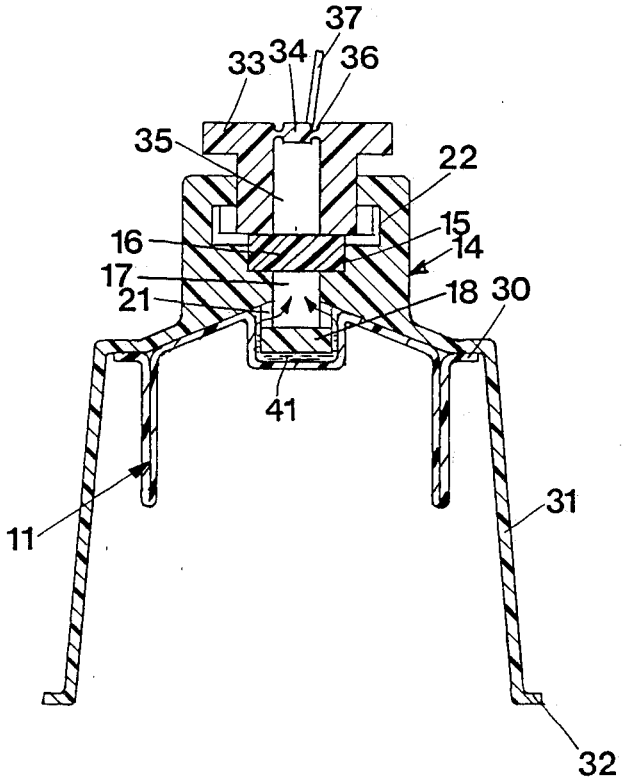
FIG. 3 shows a section through a further embodiment of the vessel according to the invention.
Figure 4:
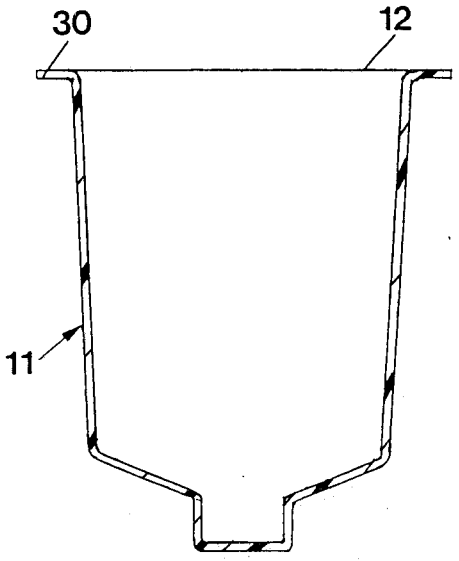
FIG. 4 shows a section through the flexible vessel in its original shape according to the embodiment shown in FIG. 3.

According to the embodiment shown in FIGS. 3 and 4 the bag 11 has the original shape seen in FIG. 4. The side edges 30 surrounding its opening 12 are welded or in another way liquid tightly connected on the inside of a slightly conical protective cover 31 which at the opposite end is provided with a supporting edge 32. Many substances are delivered as dry substances, which requires only a very small portion of the volume of the bag 11, as shown at 41 in FIG. 3. If the air is evacuated from the bag 11 this can be folded and brought into the protective cover against the bottom thereof, i.e. towards the connection member 14 and the protective member 18 as is shown in FIG. 3. During transport and storing the slightly conical protective covers 31 can be nested into each other, whereby a very space saving package has been provided.

The protective cover 31 is at the end facing away from the supporting edge 32 provided with a connection member 14 with a coupling 22, which in this embodiment is a bayonet coupling, to which a plug 33 is connected. A membrane 16 covers the opening 17 of the connection member 14. Connected to said opening 17, the connection member 14 has as in the above described embodiments a protective member 18 extending into the protective cover 31, said protective member 18 being provided with radial holes 21, which permit liquid communication between the bag 11 and the opening 17.

In cases where the bag 11 contains substances for which air contamination must be prevented in a satisfactory way the plug 33 is removed after which a contamination protection, for example according to the International Patent Application No. PCT/SE84/0075 is connected to the coupling 22. If the substance in question is not so toxic, that a contamination protection is necessary, a cover 34 in an opening in the plug is removable along an indication of fraction 36 by pulling a flap 37. The needle which is to be inserted into the opening 17 of the connection member 14 through the membrane 16 is by that guided through the opening 35 in the plug 33, which latter opening 35 preferably has a smaller cross-section than the opening 17.

A further advantage of the vessel according to the invention is that there is no requirement for a special pressure equalization means which takes care of the surplus air when filling the vessel with liquid and which admits air to pass into the vessel again when liquid is sucked out therefrom as the vessel in itself consists of a flexible volume variable bag 11.

Figure 5:
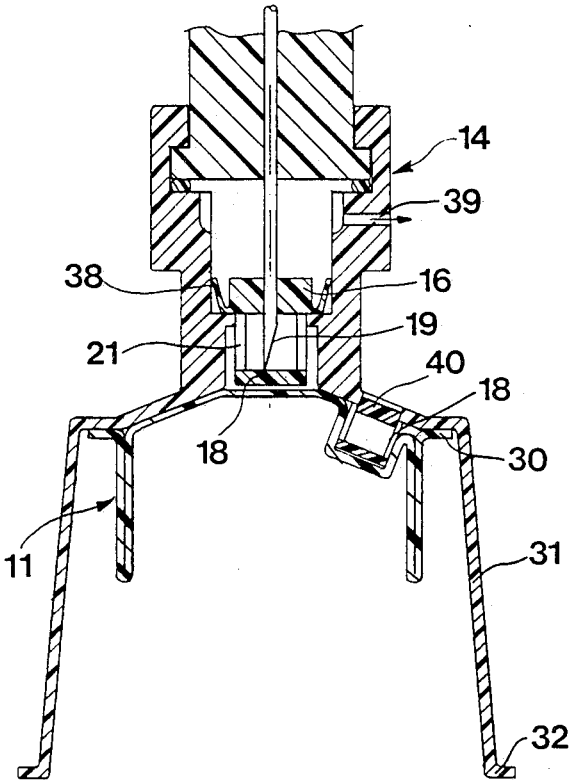
FIG. 5 shows a section through a third embodiment intended as a collecting vessel for example in connection with drainage applications.

In FIG. 5 is shown a third embodiment at first hand intended as a collecting vessel in connection with drainage or urine collection. The membrane 16 is in this case designed as a piston with lip sealing 38, which in response to an over pressure in the vessel 11 will be displaced upwards along the needle 19, whereby air can pass out through a side passage 39 in the connection member 14. The protective cover 31 can of course instead be provided with another type of non-return valve.

The protective cover is provided with a further opening sealed by a membrane 40, a protective member **18*a*** is also being arranged at said opening. Samples can for example be taken out through said opening.

The protective cover 31 can further be graduated in volume units, so that the collected liquid volume directly can be read against the position of the bag bottom with respect to the protective cover. For suction applications (drainage) a suction force must be created, for example by creating a negative pressure in the protective cover 31 by means of a suction device.

The vessel according to the invention can further be used as an infusion bag.

The invention is not limited to the embodiments shown and described but a plurality of variants are possible within the scope of the claims. Thus it would be possible to eliminate the coupling 22 for example in such cases where the substance is not harmful and the handling thereof does not involve any considerable risks. The bag 11 can of course be designed in other ways as has been shown here, for example folded, crumpled up or as a bellows.

We claim:

1. In combination, a vessel, and a material stored therein in concentrated form which is to be dissolved or diluted by a solvent prior to use, said vessel comprising:

a flexible part having a closed end and an opposite open end, the open end having a peripheral edge, said flexible part defining an interior surface and an exterior surface;

a rigid cup-shaped part having downwardly extending side walls, and an open bottom end, and defining interior and exterior surfaces, the peripheral edge of the opening in the flexible part being tightly attached to the rigid cup-shaped part such that said interior surface of the flexible part and said interior surface of the rigid cup-shaped part define a closed interior space;

an upwardly-extending connection member on the rigid cup-shaped part, the connection member having an opening therethrough and a perforable, resilient, self-sealing membrane extending across said opening, through which membrane said interior space is accessible by a puncturing member for adding solvent to said material stored in said interior space or removing dissolved or diluted material from said interior space; and a protection member supported by said rigid cup-shaped part within said interior space adjacent said opening of the connection member, for receiving such puncturing member inserted through said opening and preventing such puncturing member from contacting the flexible part, the protection member having at least one opening therein in communication with said interior space;

said concentrated material only taking up a small part of said interior space, said flexible part being configured and dimensioned such that when said interior space is at least partly evacuated, the flexible part is, because of vacuum pressure, drawn up against said interior surface of the rigid cup-shaped part and totally contained therein, and after adding solvent into said interior space for dissolving or diluting said concentrated material, said flexible part may expand towards said open bottom end of said rigid cup-shaped part.

2. A vessel as in claim 1, wherein said flexible part is evacuated and has said material in concentrated form stored therein.

3. A vessel as in claim 2, wherein said flexible part has an outwardly projecting nipple at said closed end thereof, said nipple being configured and dimensioned for closely surrounding said protection member when said flexible part is evacuated, said small part of said interior space which contains said material being defined between said nipple and said protection member.

4. A vessel as in claim 1, wherein said flexible part has an outwardly projecting nipple at said closed end thereof, said nipple being configured and dimensioned for closely surrounding said protection member when said flexible part is evacuated, said small part of said interior space which contains said material being defined between said nipple and said protection member.

5. A vessel as in claim 1, further comprising a second membrane in an opening in a portion of said rigid cup-shaped part through which said interior space is accessible by a puncturing member, and a second protection member supported by said rigid cup-shaped adjacent said membrane, for preventing such puncturing member inserted through said membrane from contacting said flexible part.

6. A vessel as in claim 1, wherein said rigid cup-shaped part, said connection member and said protection member are so configured and dimensioned that when said bag is evacuated, said vessel is nestable in series with a plurality of other such vessels, the protection member of each such vessel being received in the opening in the connection member of the next such vessel in the series.

7. A vessel as in claim 1, wherein said membrane has a flexible edge portion which secures it to said opening in said connection member, said flexible edge portion permitting said membrane to move a predetermined distance toward said bag under the influence of pressure due to said puncturing member, and to move a predetermined distance away from said bag under the influence of pressure from said bag.

8. A vessel and a material stored therein, said material being in concentrated form such as freeze-dried material, said vessel permitting said material to be dissolved or diluted by a solvent injected into said vessel by a puncturing member prior to use, said vessel being adaptable for storing said material in an at least partly evacuated condition, and said vessel comprising:

a flexible bag having a closed end and an opposite open end, the open bag end having a peripheral edge, said flexible bag defining an interior surface and an exterior surface;

a rigid connection member having downwardly depending walls which form a cover, and having an upwardly directed opening and defining an interior surface and an exterior surface, the peripheral edge of the open end in the flexible bag being hermetically connected to the walls of the rigid connection member in such a manner that said interior surface of the flexible bag and said interior surface of the rigid connection member define a closed interior space;

said opening in said connection member having a perforable, resilient, self-sealing membrane extending across the opening, through which membrane said interior space is accessible by such puncturing member, for adding such solvent to or removing the dissolved or diluted material from said interior space; and a protection member supported by the rigid connection member within said interior space adjacent said opening of the connection member, for preventing such puncturing member inserted through the connection member from contacting the flexible bag, the protection member having at least one opening therein in communication with said interior space;

said concentrated material only taking up a small part of said interior space, said flexible bag being configured and dimensioned such that when at least partly evacuated, the flexible bag is, because of vacuum pressure, drawn up against said interior surface of the rigid cover and totally received therein and protected inside the walls of said rigid cover, and after adding the solvent into said interior space for dissolving or diluting said concentrated material, the flexible bag may expand in said rigid cover.

9. A vessel as in claim 8, wherein said bag is evacuated and has said material in concentrated form stored therein.

10. A vessel as in claim 9, wherein said bag has an outwardly projecting nipple at said closed end thereof, said nipple being configured and dimensioned for closely surrounding said protection member when said bag is evacuated, said small part of said interior space which contains said material being defined between said nipple and said protection member.

11. A vessel as in claim 8, wherein said bag has an outwardly projecting nipple at said closed end thereof, said nipple being configured and dimensioned for closely surrounding said protection member when said bag is evacuated, said small part of said interior space which contains said material being defined between said nipple and said protection member.

12. A vessel as in claim 8, further comprising a second membrane in an opening in a portion of said cover through which said interior space is accessible by a puncturing member, and a second protection member supported by said cover adjacent said membrane, for preventing such puncturing member inserted through said membrane from contacting the flexible bag.

13. A vessel as in claim 8, wherein said cover, said connection member and said protection member are so configured and dimensioned that when said bag is evacuated, said vessel is nestable in series with a plurality of other such vessels, the protection member of each such vessel being received in the opening in the connection member of the next such vessel in the series.

14. A vessel as in claim 8, wherein said membrane has a flexible edge portion which secures it to said opening in said connection member, said flexible edge portion permitting said membrane to move a predetermined distance toward said bag under the influence of pressure due to said puncturing member, and to move a predetermined distance away from said bag under the influence of pressure from said bag.

15. In combination, a vessel, and a material stored therein in concentrated form which is to be dissolved or diluted by a solvent prior to use, said vessel comprising:

a flexible part having a closed end and an open end, said flexible part defining an interior surface and an exterior surface;

a rigid part having side walls and an open end, and defining interior and exterior surfaces, the open end of the flexible part being tightly attached to the rigid part such that said interior surface of the flexible part and said interior surface of the rigid part define a closed interior space;

a connection member on the open end of the rigid part, the connection member having an opening therethrough which communicates with said open end of said rigid part, and perforable membrane means extending across said opening, through which membrane means said interior space is accessible by a puncturing member for adding solvent to said material stored in said interior space or removing dissolved or diluted material from said interior space; and a protection member supported by said rigid part within said interior space adjacent said opening of the connection member, for receiving such puncturing member inserted through said opening and preventing such puncturing member from contacting the flexible part, the protection member having at least one opening therein in communication with said interior space;

said concentrated material only taking up a small part of said interior space, said flexible part being configured and dimensioned such that when said interior space is at least partly evacuated, the flexible part is, because of vacuum pressure, drawn up against said interior surface of the rigid part, and after adding solvent into said interior space for dissolving or diluting said concentrated material, said flexible part may expand towards said open end of said rigid part.

16. A vessel and a material stored therein, said material being in concentrated form such as freeze-dried material, said vessel permitting said material to be dissolved or diluted by a solvent injected into said vessel by a puncturing member prior to use, said vessel being adaptable for storing said material in an at least partly evacuated condition, and said vessel comprising:

a flexible bag having a closed end and an open end, said flexible bag defining an interior surface and an exterior surface;

a rigid connection member and walls extending from said connection member which form a cover, and said connection member and walls having a common opening and defining an interior surface and an exterior surface, the open end of the flexible bag being hermetically connected to the walls such that said interior surface of the flexible bag and said interior surface of the walls define a closed interior space;

said opening in said connection member having perforable membrane means extending across the opening, through which membrane means said interior space is accessible by such puncturing member, for adding such solvent to or removing the dissolved or diluted material from said interior space; and a protection member supported by the rigid connection member within said interior space adjacent said opening of the connection member, for preventing such puncturing member inserted through the connection member from contacting the flexible bag, the protection member having at least one opening therein in communication with said interior space;

said concentrated material only taking up a small part of said interior space, said flexible bag being configured and dimensioned such that when at least partly evacuated, the flexible bag is, because of vacuum pressure, drawn up against said interior surface of the rigid cover and thereby protected inside the walls of said rigid cover, and after adding the solvent into said interior space for dissolving or diluting said concentrated material, the flexible bag may expand in said rigid cover.

* * * * *